United States Patent [19]

Bierwith et al.

[11] 4,360,981

[45] Nov. 30, 1982

[54] LIP AND TOOTH COMBINATION FOR BUCKET WHEEL EXCAVATOR

[75] Inventors: Stanton F. Bierwith, San Leandro; Robert S. Bierwith, Mill Valley, both of Calif.

[73] Assignee: Suncor Inc., Toronto, Canada

[21] Appl. No.: 859,366

[22] Filed: Dec. 12, 1977

[51] Int. Cl.[3] ..... E02F 9/28

[52] U.S. Cl. ..... 37/141 T

[58] Field of Search ..... 37/142 R, 142 A, 141 T, 37/141 R

[56] References Cited

U.S. PATENT DOCUMENTS

| | | | |
|---|---|---|---|
| 1,890,997 | 12/1932 | Lane | 37/142 R |
| 2,204,718 | 6/1940 | Younie | 37/142 R |
| 2,305,653 | 12/1942 | Ward | 37/142 R |
| 3,397,012 | 8/1968 | Krekeler | 37/142 R X |
| 3,471,954 | 10/1969 | Spivey | 37/142 A |
| 3,665,623 | 5/1972 | White | 37/142 A |
| 3,791,054 | 2/1974 | Bierwith | 37/141 R |
| 3,947,982 | 4/1976 | Mantovani | 37/141 R |
| 4,050,172 | 9/1977 | Petersen | 37/142 A |

FOREIGN PATENT DOCUMENTS

| | | | |
|---|---|---|---|
| 2153964 | 9/1972 | Fed. Rep. of Germany | 37/142 R |
| 1410814 | 10/1975 | United Kingdom | 37/142 A |

*Primary Examiner*—Clifford D. Crowder

*Attorney, Agent, or Firm*—J. Edward Hess; Donald R. Johnson; James H. Phillips

[57] ABSTRACT

Removable bucket wheel teeth are provided with a rectangular-in-cross section shank portion and forwardly sloped shoulder areas for insertion into a complementarily-configured socket in a bucket lip. The resulting assembly is much more rigid and wears better than prior art tooth and lip configurations and tends to fracture preferentially when overstressed.

14 Claims, 12 Drawing Figures

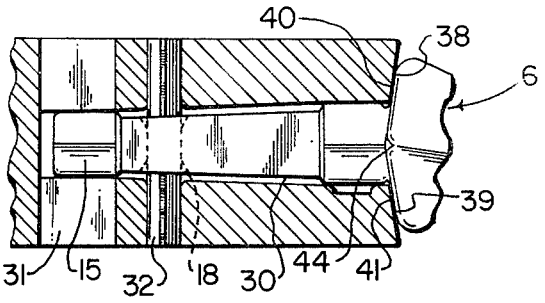
FIG. 8A
FIG. 1
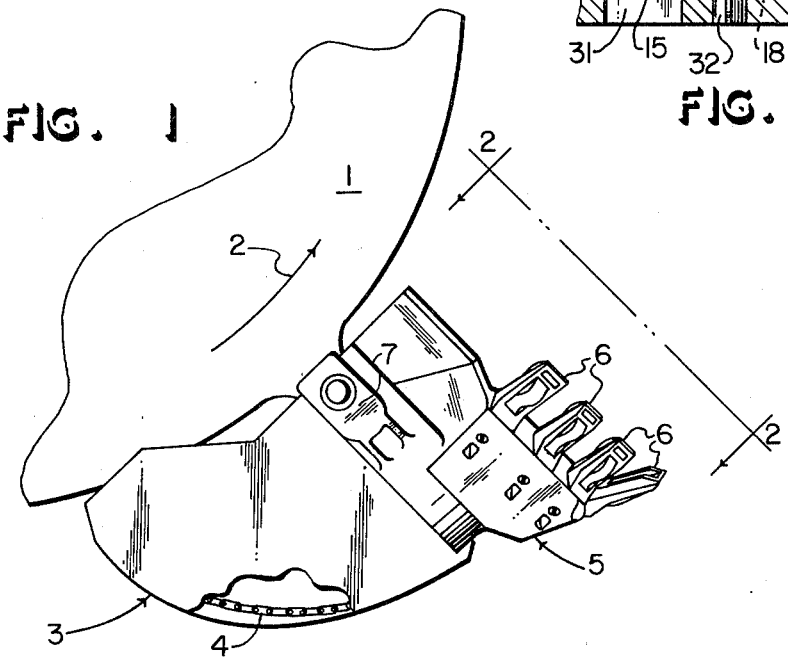
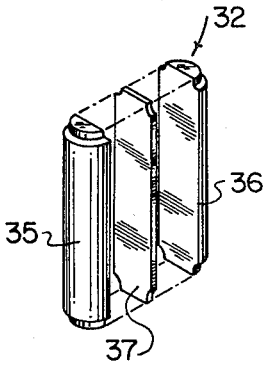
FIG. 9
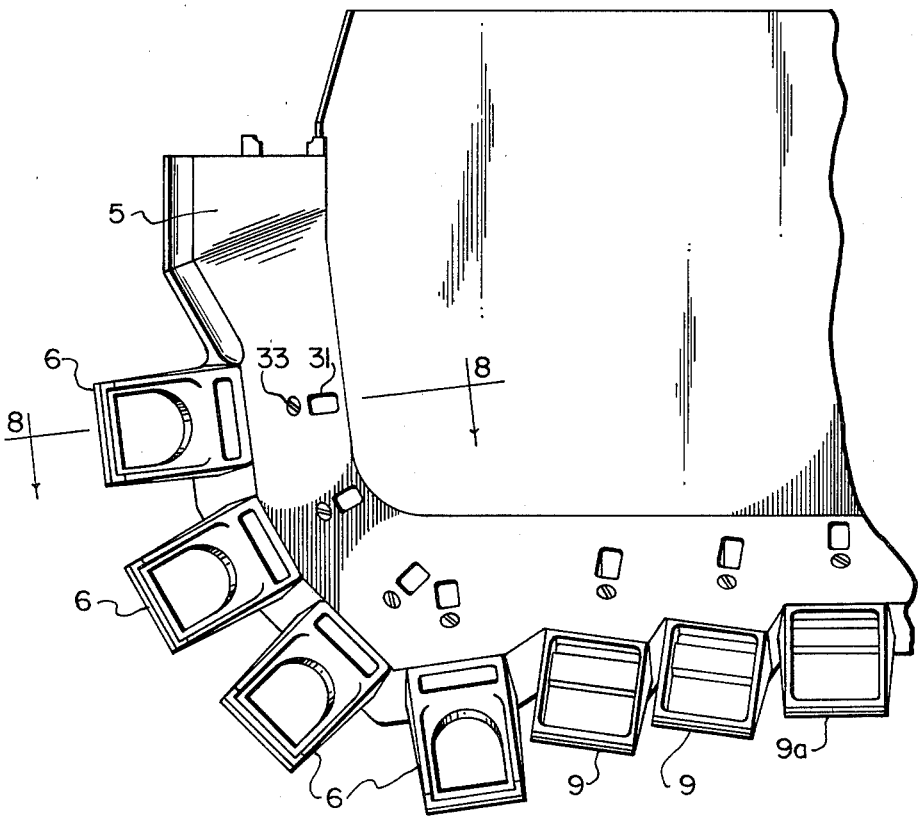
FIG. 2

LIP AND TOOTH COMBINATION FOR BUCKET WHEEL EXCAVATOR

BACKGROUND OF THE INVENTION

This invention relates to the excavating arts, and more particularly, to improvements in removable tooth-/lip configurations such as may be used in the buckets of bucket wheel excavators or the like.

One environment in which the present invention finds great utility is in the mining of tar sands which are very difficult to work, particularly in harshly cold environments.

Tar sands (also known as oil sands and bituminous sands) are sand deposits which are impregnated with dense, viscous petroleum. Tar sands are found throughout the world, often in the same geographical area as conventional petroleum. The largest deposit, and the only one of present commercial importance, is in the Athabasca area in the Northeast of the Province of Alberta, Canada. This deposit contains over 700 billion barrels of bitumen. For comparison, this is about one-sixth of the U.S. coal reserves. It is just about equal to the known world oil reserves.

Tar sand has been defined as sand saturated with a highly viscous crude hydrocarbon material not recoverable in its natural state through a well by ordinary production methods. Strictly speaking, the material should perhaps be called bituminous sand rather than tar sand since the hydrocarbon is a bitumen (carbon disulfide soluble oil). In petroleum refining, tar is a term reserved for the residue of a thermal process. The term oil sand is used also, possibly in allusion to the synthetic crude oil which can be manufactured from the bitumen.

It has long been realized that tar sand is a mixture of sand, water, and bitumen. The sand component is predominantly quartz, in the form of rounded or sub-angular particles. Each grain of sand is wet with a film of water. Surrounding the wetted sand grains, and somewhat filling the void volume among them, is a film of bitumen. The balance of the void volume is filled with connate water, and, in some instances, a small volume of gas. The gas is usually air, but some test borings in the Athabasca deposit have reported methane. The sand grains are packed to a void volume of about 35%. This corresponds to a tar sand mixture of roughly 83 wt.% sand, the balance being bitumen and water. In fact, it is found with considerable regularity, that the bitumen and water weight percentages total about 17% of the tar sands.

There are two basic approaches to recovering bitumen from tar sand. The tar sands may be mined and transported to a processing plane where the bitumen is extracted and the sand is discharged. Alternatively, the separation of bitumen from sand may be accomplished without ever moving the sand, that is, in situ. In situ processes have a great deal in common with tertiary recovery of conventional crude oil. To date, no commercial in situ operations have been developed in the Athabasca region although numerous development projects are being studied.

Almost 200 years after the discovery of the oil bearing sands by Peter Pond, the Great Canadian Oil Sands, Ltd., (GCOS), a subsidiary of the Sun Company of Philadelphia, Pa., was the first company to take the risk of producing synthetic crude oil from oil sands. In 1962, the Alberta Provincial Government granted GCOS the prospecting rights for Lease IV, about 32 kilometers north of Ft. McMurray on the banks of the Athabasca River. This is one of the areas with the smallest overburden thickness such that the tar sand can be fairly readily mined and transported from the formation to a processing plant. In order to support synthetic crude production in a plant of economical size, an immense mining operation is called for. For instance, the GCOS project was designed to produce 45,000 barrels per calendar day of synthetic crude for which a tar sand mining rate of about 100,000 tons per day is necessary (In fact, these figures are now routinely exceeded.) This refers to the tar sand (ore) only and does not include the overburden which must be stripped away in order to expose the tar sand for mining. This mining rate is of the order of the size of the largest mines in North Amercia. Because of the large scale of mining involved, only open pit methods have been commercially employed for exploiting the Athabasca tar sands.

Because of the relatively low unit value of tar sand as an ore, mining and transportation costs must be rigorously minimized. This means, among other things, that the feed must receive only a minimum amount of handling between the mine and the processing plant. On the other hand, for economy of operation in the processing plant, continuous units must be designed to operate with a relatively steady feed rate, round the clock. While such processing is usual in petroleum refineries, it is very definitely the exception in mining. Thus, quite apart from the relatively large scale, tar sand mining presents the unique problem of assuring a relatively steady feed rate to the processing plant, round the clock and year around. In addition to this requirement, which is general for any tar sand formation, the Athabasca tar sands present two other significant problems for mining; viz.: (1) tar sand in-place requires very large cutting forces and is extremely abrasive to the cutting edges exposed to it; and (2) both the equipment and pit layouts must be designed to operate during the long Canadian winters at temperatures as low as 60° F. below zero.

Basically, there are two approaches to the open pit mining of tar sands. The first is to use a few mining units of custom design, which will necessarily be very expensive. For instance, large units which have been considered are bucket wheel excavators, dredges (both hydraulic and bucket ladder) and super-sized drag lines. The other approach is to use a multiplicity of smaller mining units of conventional design and relatively much lower unit cost. For example, scrapers and truck-and-shovel operations have been considered. Each method has advantages and its own peculiar risks. The former method has been adopted by GCOS and will be followed by the even larger Syncrude project which is located a few miles from the GCOS plant and which is scheduled to commence commercial operation in 1978.

In the GCOS mine, the ore body is divided into two layers or benches, each nominally 75′ in height. The pit floor and the dividing plane between the upper and lower bench are roughly horizontal. Mining of tar sands is carried out by two giant bucket wheel excavators, and the overburden is removed by a third giant bucket wheel excavator. Tar sands loosened from the face of each bench by the bucket wheel are discharged onto a crawler-mounted conveyor or belt wagon which in turn discharges the ore onto movable conveyors. These conveyors are advanced from time to time in the direction of mining. The movable conveyors discharge onto truck conveyors which in turn feed a main conveyor. The main conveyor carries the tar sand ore to the processing plant where it is converted to synthetic crude oil.

Each of the tar sands bucketwheel excavators in operation at GCOS is capable of mining in excess of 9,000 tons per hour, more than enough to feed the entire plant. However, those knowledgeable in the art will appreciate that tar sands is a very difficult medium to work, particularly in hostile environments such as that experienced in the Athabasca region during the winter months. As a result, very careful attention has been given to the development of bucket wheel buckets employing carefully configured and distributed teeth which are readily individually removable for replacement after they have become worn.

In the open pit mining of tar sand, one procedure which may be followed is to slue the buckets across the face of the work (i.e., to move them laterally or sideways across the working face), to thereby take a substantially horizontal cut of the sands. Thus, the actual cutting is primarily carried out by teeth disposed on the sides of the bucket. In the best prior art configuration, a tooth-mounting bucket wheel has a variable profile, formed by the relieving of the center of the lip in both planes. The lip member is of generally U-shaped configuration, viewed head-on or looking into the bucket, and is skewed rearwardly at its two opposite ends. The end face of the lip member is provided with a plurality of sockets for individually receiving the shanks of chisel-shaped excavating teeth, and the member has means for removably securing the teeth in position in their respective sockets. For a more complete description of such prior art system, one may refer to U.S. Pat. No. 3,791,054 entitled "Lip Construction for Bucket Wheel Excavators" issued Feb. 12, 1974 and corresponding Canadian Pat. No. 941,861, issued Feb. 12, 1974, both assigned to Great Canadian Oil Sands, Ltd. Briefly, however, it may be noted that the bucket wheel system disclosed in these references employ removable teeth having oval-in-cross section shank portions which fit into complementarily configured apertures distributed about the bucket lip. Because the time spent changing out these teeth is substantial and to the detriment of the ore throughput in the mine and because the wear observed both to the teeth shanks and, more importantly, to the teeth receiving sockets in the bucket lips has proven considerable, it will be readily apparent to those skilled in the art that it would be highly desirable to provide a bucket tooth/lip configuration by which the period during which a set of teeth may remain in operation is substantially extended while, simultaneously, improved wear characteristics are imparted to the system in order that replacement teeth will continue to fit rigidly into the sockets about the bucket lip.

A related and very serious problem which has been observed during the use of the prior art bucket lip/-removable tooth system is a tendency for overstressed teeth to fracture at the base of their distal portions. When such fracture occurs, the bucket lip must directly address the material being mined and begins to wear rapidly. Consequently, replacement teeth will not fit correctly, and the lip geometry is altered, conditions which quickly render a bucket virtually useless. It then becomes necessary to change out the entire bucket with a heavy penalty, not only in capital investment, but in down time. It will therefore be understood by those skilled in the art that it would be a most important step forward in the art to provide means by which tooth fracture, if it occurs, takes place outboard from the base of the tooth distal portion in order that the bucket lip will remain shielded from the material being mined.

It is therefore a broad object of our invention to provide improved means for mining abrasive and difficult to work ore materials.

It is another object of our invention to provide in an excavating system, a removable tooth/bucket lip configuration by which teeth fitted to a bucket may remain in service for extended periods of time.

It is yet another object of our invention to provide such a removable tooth/bucket lip configuration in which each tooth is rigidly maintained in order to avoid wear between the shank portion of the tooth and the bucket lip tooth receiving socket.

In a more specific aspect, it is an object of our invention to provide a removable tooth/bucket lip configuration in which the teeth are provided with rectangular-in-cross section shank portions and forwardly angled shoulder means for insertion into a complimentarily configured socket in the bucket wheel lip.

In another aspect, it is an object of our invention to provide such a removable tooth/bucket lip configuration in which tooth fracture, it it occurs, takes place outboard from the base of the tooth distal portion.

The subject matter of the invention is particularly pointed out and distinctly claimed in a concluding portion of the specification. The invention, however, both as to organization and method of operation, may be understood by reference to the following detailed description taken in conjunction with the sub-joined claims and the accompanying drawing of which:

FIG. 1 is a fragmentary view of a bucket wheel illustrating one of a plurality of buckets circumferentially distributed about the wheel;

FIG. 2 is a front view of half the bucket illustrated in FIG. 1 illustrating the distribution of removable teeth about the bucket lip;

Figure 3:
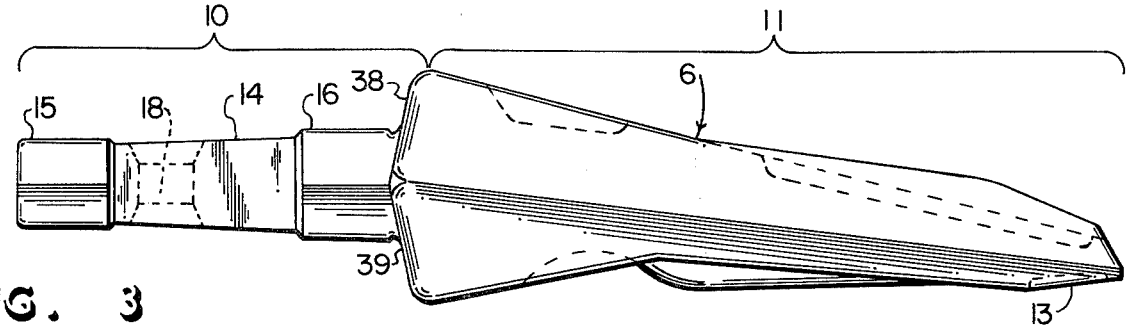
FIG. 3 is a side view of a first type of removable tooth employed in the bucket system.
Figure 8B:
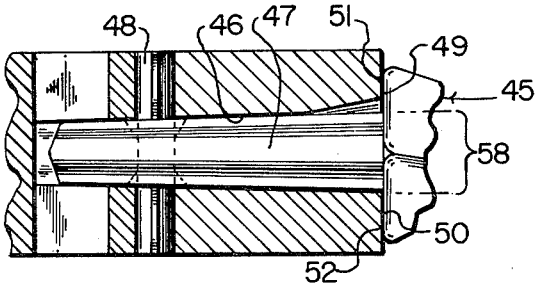
FIG. 8B (PRIOR ART)
Figure 10:
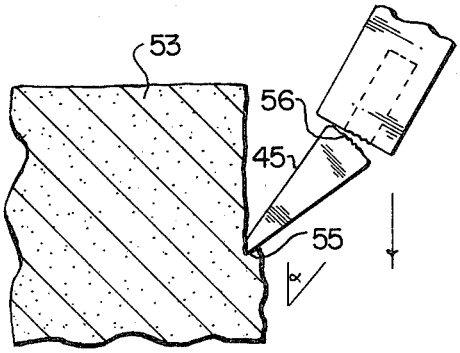
FIG. 10 (PRIOR ART)
Figure 11:
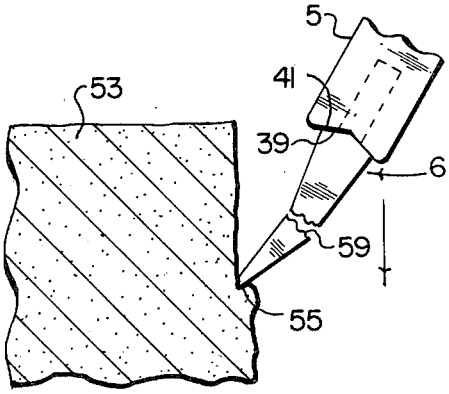

FIG. 8*a* is a fragmentary cross-sectional view taken on the lines 8—8 of FIG. 2;

FIG. 8*b* is a fragmentary cross-sectional view which would be taken along the lines 8—8 of FIG. 3 if the bucket lip/removable tooth system of FIG. 2 were configured according to the prior art;

FIG. 9 is an exploded view of a tooth retaining pin employed in the bucket lip removable tooth system;

FIG. 10 illustrates the probable fracture region of a prior art bucket lip/removable tooth combination addressing a difficult-to-work medium; and FIG. 11 illustrates the probable fracture region of a bucket lip/removable tooth combination according to the present invention addressing the same difficult-to-work medium.

Referring now to FIG. 1, a portion of a typical rotary bucket wheel excavator is indicated at 1. Mining is carried out by rotating the wheel 1 in the direction indicated by the arrow 2 while advancing the wheel toward the material being mined, which material is disposed generally vertically with respect to the wheel 1. In the mining of tar sands, for example, the wheel 1 may be moved laterally or sideways across the face of the work in order to take a substantially horizontal cut of the material.

The bucket wheel 1 has mounted thereon a plurality of circumferentially distributed, peripherally disposed excavating buckets such as the bucket 3. The bucket 3 is provided with a chain type wall 4 and a lip denoted generally by the numeral 5. Mounted on the front edge on the lip 5 are spaced apart digging teeth 6. At each end of the generally U-shaped lip 5, there is a respective integral support member 7 by which the ends of the lip are secured to respective opposite faces of the wheel 1. The wall 4 is formed of a plurality of closely-spaced parallel links of link chain, one end of each link chain being secured to the rear edge of lip 5, and the other end of each link chain being secured proximate the trailing end of the bucket assembly.

Referring now to FIG. 2, it will be observed that, in addition to the digging teeth 6 which are in view in FIG. 1, a plurality of stub teeth 9 are affixed to the bucket lip 5 in the central portion of the lip. The lip 5 is a large, heavy member (sufficiently rigid to resist the substantial stresses applied to it during excavating operations) of a generally U-shaped configuration viewed end-on from the work engaging side of the lip as in FIG. 2. FIG. 2 is, as previously noted, a partial view such that it will be understood that the right side of the lip 5 is a mirror image of the left hand side depicted in FIG. 2, and the center line of the stub tooth 9A coexists with the center line of the lip 5. Thus, a total of 8 digging teeth and five stub teeth are employed in the particular embodiment disclosed in FIGS. 1 and 2 although those skilled in the art will understand that the numbers and distribution of teeth may vary according to the size of a given bucket, the character of the material to be worked, and the manner in which it is to be worked. The bucket depicted in FIGS. 1 and 2 is specially configured to work tar sand in the slewing mode such that the digging teeth are outwardly disposed with respect to the stub teeth. The principle office of the stub teeth, in this configuration, is to prevent wear on the bucket lip while gathering the ore rather than digging into the ore bank.

Figure 4:
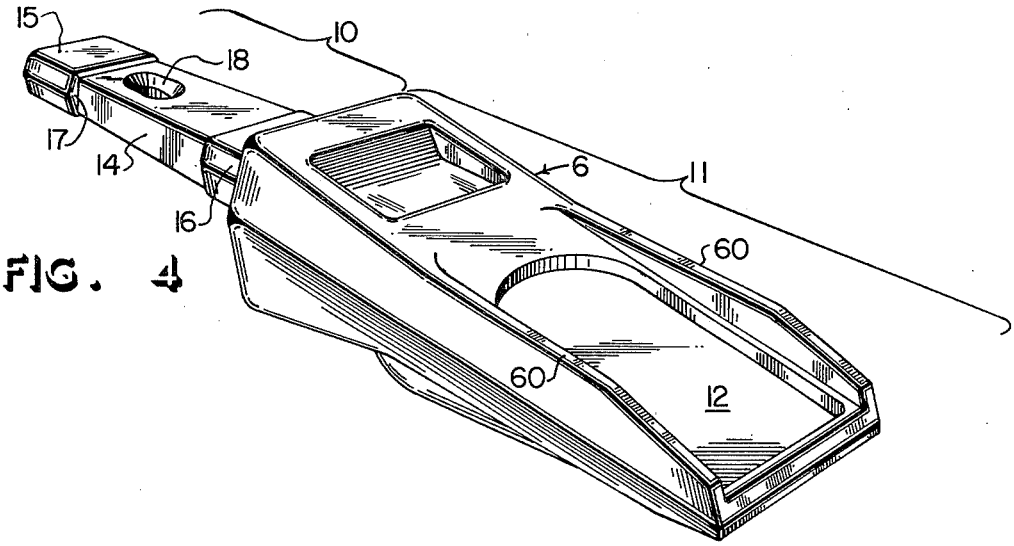
FIG. 4 is a perspective view of the tooth of FIG. 3.
Figure 5:
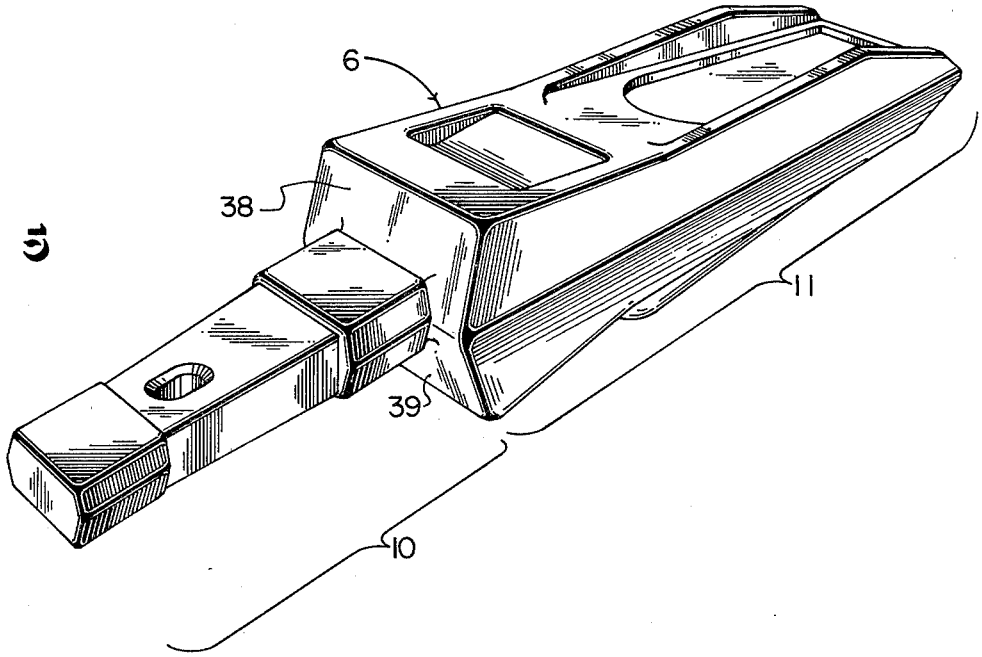
FIG. 5 is a rear three quarter perspective view of the tooth of FIG. 3.

Referring now to FIGS. 3, 4, and 5 it will be observed that the digging tooth 6 comprises a shank portion 10 and a work engaging distal portion 11. As best shown in FIG. 4, a recess 12 may be provided in the upper face of the distal portion 11 of the digging tooth 6 to receive "hard facing"; i.e., a deposit of very hard metal by which the wearing properties of the tooth are greatly improved. Another recess, 13, provided at the forward end of the lower face of the digging tooth 6, also receives a hard facing deposit. It has been found that laying hard facing in such recesses obtains the desired wear characteristics while avoiding the likelihood of the deposit popping out under stress, an undesirable condition observed from time to time in the prior art teeth.

The shank portion 10 of the digging tooth 6 has generally (although not strictly) rectangular cross-sections along its length. A central section 14 along the length of the shank 10 is slightly rearwardly tapered and is slightly undercut with respect to the rearmost 15 and forwardmost 16 sections of the shank. It will be noted, as best shown in FIG. 4, that the sides of the rear 15 and front 16 sections of the shank 10 extend slightly outwardly such that, for example, the cross-section of the shoulder 17 at the forward edge of the rear section 15 of the shank 10 is in the general form of a shallow triangle with its apex midway between the upper and lower faces and generally parallel thereto. It has been found that this form obtains a slight "draft" effect during forging of the teeth and also, as will be discussed more fully below, results in a more rigid assembly with a complementarily configured aperture in the bucket lip. The upper and lower faces, respectively, of the rear and forward shank sections 15, 16 are generally parallel to one another.

A relieved, slightly elongated aperture 18 extends between the upper and lower faces of the central section 14 of the shank 10. The purpose of this aperture will become apparent as the description of the teeth and bucket lip assembly proceeds.

The three-quarter rear perspective view, FIG. 5, of the digging tooth 6 illustrates forwardly inclined rear upper and lower faces 38 and 39, respectively, of the distal portion 11 of the digging tooth 6. As will be discussed more fully below, the faces 38 and 39 are adapted to seat against complementarily configured sockets in the bucket lip to provide a rigid structure having superior system wear and fracture characteristics.

Figure 6:
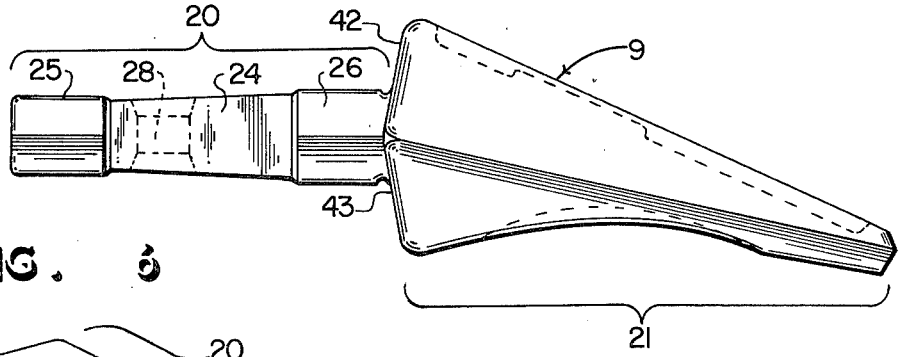
FIG. 6 is a side view of a second type of tooth employed in the bucket system.
Figure 7:
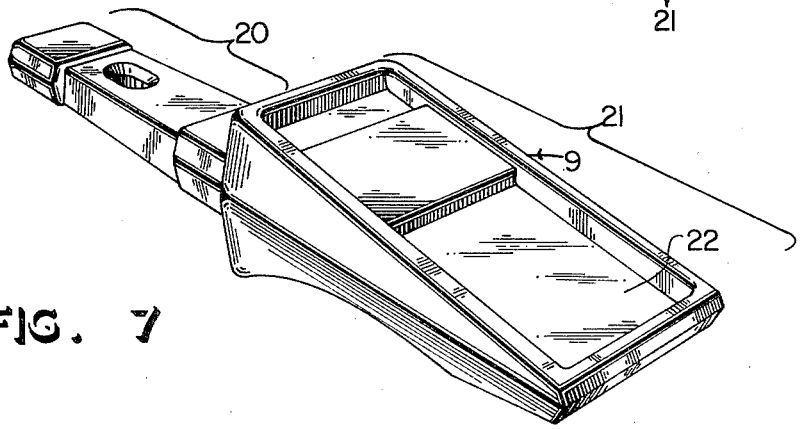
FIG. 7 is a perspective view of the tooth of FIG. 6.

Referring now to FIGS. 6 and 7, it will be seen that the stub tooth 9 depicted therein also comprises a shank portion 20 and a distal portion 21. The upper face of the distal portion 21 of the stub tooth 9 is somewhat shorter than the corresponding face of the digging tooth 6, and a shorter recess 22 is provided in the forward section of the stub tooth 9 for receiving hard facing metal. No region is provided on the lower face of the stub tooth 9 for receiving hard facing in the particular stub tooth depicted in FIGS. 6 and 7 although it will be understood that such provision is contemplated if useful for a given application.

The shank portion 20 of the stub tooth 9 is identical to the shank portion 10 of the working tooth 6. Thus, the respective sections 24, 25, 26 of the shank portion 20 of the stub tooth 9 correspond exactly to the portions 14, 15 and 16 of the cutting tooth 6, and an elongated aperture 28 is provided through the central portion 24 of the shank 20 in a manner identical to the aperture 18 in the shank portion 14 of the shank 10. The side countours of the shank sections 25 and 26 are identical to the side contours of the shank sections 15 and 16. Thus it will be understood that the shank receiving means for either the cutting tooth or the stub tooth 9 may be of identical configuration.

Reference may now be taken to FIG. 8*a* which illustrates the shank portion 10 of a cutting tooth 6 disposed within a tooth receiving socket 30. As shown in FIG. 8*a*, and also in FIG. 2, an elongated slot or knock out hole 31 extends completely through the lip 5, and the rear section 15 of the shank 10 extends substantially, but not completely, across the knock out hole when the cutting tooth 6 is seated in the socket 30. The tooth 6 is fixed in the socket 30 by a pin 32 which passes through aligned apertures 33 and 18, respectively, in the lip 5 and shank portion 10 of the tooth 6. The retaining pin 32, as shown in FIG. 9, may advantageously comprise two solid semi-cylindrical members 35 and 36 made of steel, between which is sandwiched a pad member 37 made of a suitable elastic or resilient material such as Neoprene. Resilience of the pad 37 provides a composite pin which has a driving fit within the aligned holes 33, 18. Thus, the retaining pin 32 can be driven into and out of the aligned apertures 33, 18 by the application of a suitable driving force to fix or release the tooth 6.

After the retaining pin 32 has been removed from engagement with any particular tooth, a wedge-shaped tool may be inserted into the corresponding knock out hole 31 against the inner end face of the tooth shank and driven outwardly to eject the tooth from its socket or at least to loosen it so it can then be removed manually.

Referring to FIGS. 3, 5 and 8*a*, it will be noted that the rer upper and lower faces 38 and 39, respectively, of the distal portion 11 of the digging tooth 6 are inclined slightly from the vertical with respect to the axis of the shank portion 10, the line segment 44 at which the faces 38 and 39 join the shank 10 being positioned slightly rearwardly with respect to the body of the distal portion 11. The socket 30 is provided with complementarily shaped shoulders 40 and 41 for abutting engagement with the faces 38 and 39, respectively. This configuration provides a very rigid structure to the assembly by which wear to the shank 10 and the socket 30 is minimized. Further, it has been found that this rigid construction permits a more complete delivery to the material being mined of the force imparted by the bucket such that more efficient ore removal is effected.

As previously stated, the shank 20 of the stub tooth 9 is identically configured to the shank 10 of the digging tooth 6. It will be further understood that the rear, upper and lower faces 42, 43 respectively, of the stub tooth 9 may either be identical to the corresponding faces 38, 39 of the digging tooth 6, or may be disposed at somewhat different angles and thus adapted to fit into sockets having correspondingly adjusted shoulder portions in order to differentiate between locations on the lip 5 for digging teeth 6 and stub teeth 9. Preferably, the angle between a plane to which the axes of the shanks 10 and 20 of the digging tooth 6 and stub tooth 9, respectively, are normal is on the order of 10°. This angle may, however, lie in the range from 5° to 30° and still obtain the benefit of a very rigid tooth/bucket lip coupling.

Consider now the prior art tooth/bucket lip coupling illustrated in FIG. 8*b* where the shank 47 of prior art tooth 45 is fixed within a socket 46 by a retaining pin 48. It will be observed that the rear, upper and lower faces, 49 and 50, respectively, of the distal portion of the tooth 45 are substantially coplanar and that the axis of the shank 47 is substantially normal to the common plane. Similarly, upper and lower shoulders, 51 and 52, respectively, of the socket opening are substantially coplanar to abuttingly engage the faces 49 and 50.

FIG. 10 illustrates the effect on the prior art tooth/lip 45 system upon engagement with such difficult-to-work material 53 that fracture of the tooth may occur. As more completely set forth in previously referenced corresponding U.S. and Canadian Pat. Nos. 3,791,054 and 941,861, respectively, and as will be apparent from FIG. 2, the various teeth distributed about a bucket lip address the face of the material being mined at various angles, such as the angle $\alpha$ in FIG. 10. When the tooth 45, traveling in the direction indicated by the arrow 54, encounters a region 55 of the material 53 being mined which is so tough (as, for example, where a rock is situated) that tooth fracture is inevitable, stress in the tooth distal portion concentrates at the position 56. Consequently, in theory and in observed practice, fracture tends to occur and does occur at the junction 58 (see FIG. 8*b*) of the distal and shank portion of the prior art tooth 45 leaving the bucket lip completely exposed and subject to rapid and fatal deterioration.

This result may be compared to that which takes place under like conditions when the bucket lip/removable tooth system of the present invention is employed. As shown in FIG. 11, the tooth 6, upon encountering the region 55 of the material 53 being mined whereat the tooth must fracture. is subjected to stress which is communicated to the base of the tooth distal portion. There, the stress is spread fairly evenly over the entire area of the face 39, then across to the shoulder 41 and into the adjacent area of the lip 5. Since the force is distributed across a smaller cross-sectional area toward the tip of the distal portion of the tooth 6, fracture must occur at some intermediate point 59 in the distal portion at which neither the elasticity nor the strength of the tooth can withstand the stress. An intermediate fracture region can be promoted to some extent, by the provision of gussets 60 on the tooth distal portion as best shown in FIG. 4. When fracture occurs at such an intermediate position in the tooth distal portion, the bucket to which the fractured tooth is affixed may be left in service, at somewhat decreased efficiency, without ruining the bucket lip, thereby also avoiding an unscheduled complete shutdown of the entire bucketwheel excavator to effect tooth replacement. As previously noted, those experienced in the relevant field will appreciate the fundamental significance of avoiding bucket lip wear and, particularly, equipment shutdown occasioned by the occurance of a broken tooth. The system of the present invention permits replacement of broken teeth to be postponed until the normal time for replacing an entire tooth set. Alternatively, if the efficiency of the excavator is sufficiently impaired that it cannot be permitted to run until a normal tooth life cycle is completed, their operation can at least be continued until a relatively convenient time for changing one or a few broken teeth.

While the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

What is claimed is:

1. A removable tooth system for an excavating bucket comprising:

(A) a rigid bucket lip of generally U-shaped configuration viewed head on from the work engaging side of said lip, wherein the base of the "U" is substantially straight;

(B) a plurality of transversely spaced and generally longitudinally extending sockets distributed over the base and legs of the "U" for receiving the shank portions of respective excavating teeth;

(C) a plurality of excavating teeth, one of said excavating teeth affixed in each said socket, each of said excavating teeth comprising:

(a) a socket engaging shank portion, said shank portion having forward, central, and rear sections, said forward section having generally parallel upper and lower surfaces, said rear section having generally parallel upper and lower surfaces more closely spaced than said upper and lower surfaces of said forward section, said central section having upper and lower surfaces tapering from a rear edge of said forward section to a forward edge of said rear section; and (b) a work engaging distal portion having rearwardly directed upper and lower faces joining to said forward section of said shank portion, said upper and lower faces being angularly disposed with respect to one another and to the axis of said shank portion such that said upper and lower faces meet at a line segment generally parallel to said upper and lower surfaces to said forward section of said shank portion.

2. The system of claim 1 wherein each of said sockets includes shoulder means complementarily configured with respect to said upper and lower faces such that the surfaces of said upper and lower faces seat against the surfaces of said shoulder means when a tooth is seated in said socket.

3. The system of claim 2 in which the angles between said upper and lower faces and a plane to which the axis of said shank portion is normal each fall within the range 5° to 30°.

4. The system of claim 3 in which said angles are substantially equal.

5. The system of claim 2 in which the angles between said upper and lower faces and a plane to which the axis of said shank portion is normal is approximately 10°.

6. The system of claim 2 in which said excavating teeth include a plurality of digging teeth and a plurality of stub teeth, said digging teeth and said stub teeth having identical shank portions.

7. The system of claim 6 in which said upper and lower faces of both said digging teeth and said stub teeth are angled identically with respect to respective shanks thereof.

8. A tooth as set forth in claim 1 in which said central section of said shank portion is undercut whereby a forwardmost part of said central section is displaced inwardly toward the axis of said shank portion with respect to said upper and lower surfaces of said forward section and a rearmost part of said central section is displaced inwardly toward the axis of said shank portion with respect to said upper and lower surfaces of said rear section.

9. In an excavating system employing a bucket lip provided with a plurality of sockets for receiving a corresponding plurality of removeable excavating teeth, the improvement in which each of said excavating teeth comprises:

(A) a socket engaging shank portion, said shank portion having forward, central, and rear sections, said forward section having generally parallel upper and lower surfaces, said rear section having generally parallel upper and lower surfaces more closely spaced than said upper and lower surfaces of said forward section, said central section having upper and lower surfaces tapering from a rear edge of said forward section to a forward edge of said rear section; and (B) a work engaging distal portion having rearwardly directed upper and lower faces joining to said forward section of said shank portion, said upper and lower faces being angularly disposed with respect to one another and to the axis of said shank portion such that said upper and lower faces meet at a line segment.

10. The system of claim 9 in which each socket of said plurality of sockets includes shoulder means complementarily configured with respect to said upper and lower faces such that the surfaces of said upper and lower faces seat against the surfaces of said shoulder means when a tooth is seated in its socket.

11. The system of claim 10 in which the angles between said upper and lower faces and a plane to which the axis of said shank portion is normal each fall within the range 5° to 30°.

12. The system of claim 11 in which said angles are equal.

13. The system of claim 12 in which said angles are approximately 10°.

14. A tooth as set forth in claim 9 in which said central section of said shank portion is undercut whereby a forwardmost part of said central section is displaced inwardly toward the axis of said shank portion with respect to said upper and lower surfaces of said forward section and a rearmost part of said central section is displaced inwardly toward the axis of said shank portion with respect to said upper and lower surfaces of said rear section.

* * * * *